US005560085A

United States Patent [19]

Egerer

[11] Patent Number: 5,560,085

[45] Date of Patent: Oct. 1, 1996

[54] NEEDLE FOR A NEEDLE BAR OR ROD FOR TEXTILE COMBING MACHINES, AND A NEEDLE BAR WITH SUCH NEEDLES, AS WELL AS A METHOD FOR ATTACHING OR REPLACING AN OUTFIT OF SUCH NEEDLES

[75] Inventor: Josef Egerer, Schwabach, Germany

[73] Assignee: Staedtler & Uhl, Schwabach, Germany

[21] Appl. No.: 493,990

[22] Filed: Jun. 23, 1995

[30] Foreign Application Priority Data

Jun. 30, 1994 [DE] Germany ..... 44 22 955.0

[51] Int. Cl.[6] ..... D01G 19/10; D01G 19/02; D01G 15/88; D01H 5/14

[52] U.S. Cl. ..... 19/129 R; 19/114; 492/38

[58] Field of Search ..... 19/114, 129 R, 19/215, 234; 101/375; 492/38, 43, 48

[56] References Cited

U.S. PATENT DOCUMENTS

| | | | |
|---|---|---|---|
| 431,174 | 9/1890 | Sargent | 492/38 |
| 1,783,868 | 12/1930 | Wenzel | 492/48 X |
| 1,963,365 | 6/1934 | Herold | 492/38 X |
| 2,790,386 | 4/1957 | Klaus | 101/375 |
| 3,718,959 | 3/1973 | Sailas | 492/38 X |
| 4,394,789 | 7/1983 | Egerer | 19/234 X |
| 4,606,095 | 8/1986 | Egerer . | |
| 4,627,131 | 12/1986 | Iwata . | |
| 4,893,380 | 1/1990 | Graf | 19/114 |
| 5,109,574 | 5/1992 | Eichenberger | 19/215 X |
| 5,201,098 | 4/1993 | Egerer . | |

FOREIGN PATENT DOCUMENTS

| | | | |
|---|---|---|---|
| 1936323 | 7/1969 | Germany . | |
| 220479 | 8/1924 | United Kingdom | 19/129 R |
| 2090880 | 7/1982 | United Kingdom | 19/129 R |
| 2121842 | 1/1984 | United Kingdom | 19/129 R |
| WO90/07596 | 7/1990 | WIPO | 19/129 R |

*Primary Examiner*—John J. Calvert
*Attorney, Agent, or Firm*—Browdy and Neimark

[57] ABSTRACT

In a needle for a needle bar or rod, the needle comprising a fastening area at its foot and above this an actively combing tip area, the needle being a stamped element and the fastening area having a recess closed or open outwards for the needle to be slipped on a support rod, the recess being non-circular or having projections or indents corresponding to the cross-section of the support rod such that the needle is disposed non-rotatably on the support rod, it is provided, with a view to convenience of replacement and simplicity of design of a needle bar, that for textile combing machines, in particular drawing equipments, for intersecting machines, feed combs, top combs, round combs or the like, the tip area is distinctly higher than the fastening area and is made approximately oval in cross-sectional shape by stamping.

14 Claims, 2 Drawing Sheets

1a
1b
1c
1d
2a
2b
2c
3a
3b
3d
4a
4b
5
6
7
8b
8c
8d
9
III
VI
XI

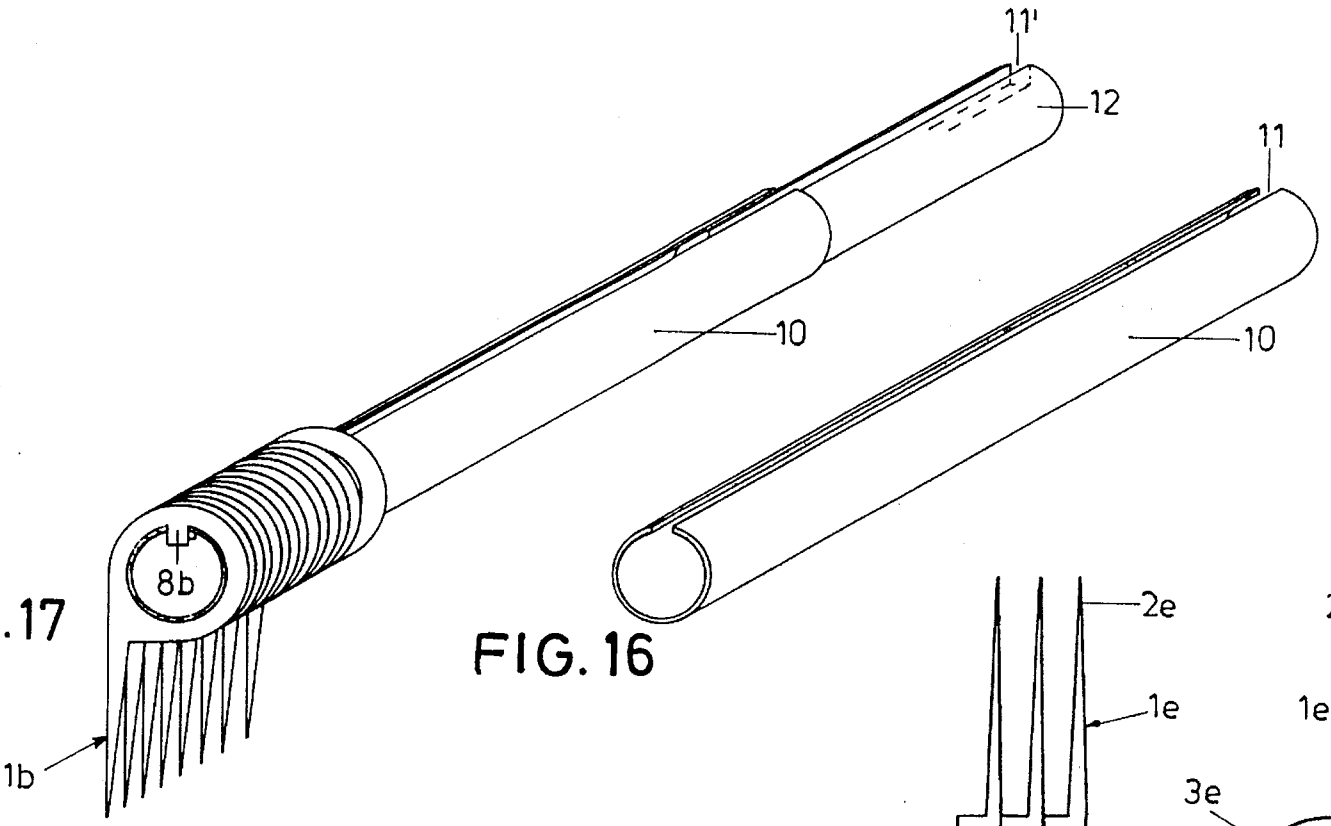
FIG.16
FIG.17
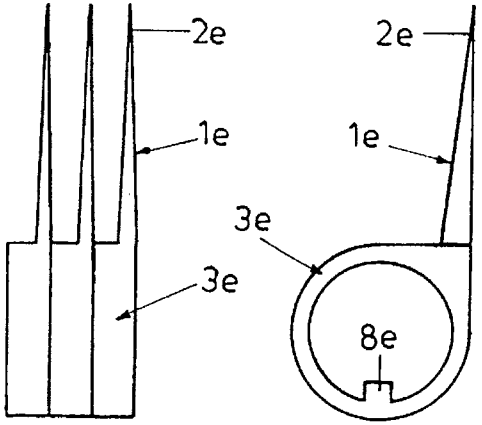
FIG.15
FIG.14

NEEDLE FOR A NEEDLE BAR OR ROD FOR TEXTILE COMBING MACHINES, AND A NEEDLE BAR WITH SUCH NEEDLES, AS WELL AS A METHOD FOR ATTACHING OR REPLACING AN OUTFIT OF SUCH NEEDLES

BACKGROUND OF THE INVENTION

1. Field of the Invention

The invention relates to a needle for a needle bar or rod, the needle comprising a fastening area at its foot area and above this an actively combing tip area, as well as to a needle bar equipped with such needles. The needle is a stamped element wherein the fastening area has a recess closed or open outwards for the needle to be slipped on a support rod. The recess is non-circular or has projections or indents corresponding to the cross-section of the support rod such that the needle is disposed non-rotatably on the support rod.

2. Background Art

Needles of this type are known from DE 19 36 323 A1. The needles of the needle bars in such textile machines are subject to wear during operation and they tend to break off. Therefore, it is necessary to replace the needle bars after a certain service life. Consequently, there is the prerequisite that such needle bars be fixed to the needle support to be easily attachable and detachable; on the other hand, absolutely reliable fit of the needle bars on the support must be assured during operation.

To this end, various fastening techniques have been developed. In particular, it is known to arrest needle bars as a pre-assembled line of needles in the needle support or, respectively, in a longitudinal groove of the latter by soldering. Further, fastening by gluing has become known. Other solutions provide for knob-type projections to be disposed on the side walls of the foot of the needle bars, so that the needle bars can be inserted in the way of a slide lock into corresponding grooves of the needle bar support.

These prior art solutions are disadvantageous in that they do not ensure sufficiently easy handling or reliable fastening, nor are they suitable for needle bars having a foot formed by a plastic strip.

Applicant's U.S. Pat. No. 5,201,098 teaches a solution for the fastening of needles on a needle bar that permits improved replacing as compared to prior art solutions, the individual needles of conventional manufacture and shape being combined along their foot area by a plastic strip, this strip being fixed to a support rod. But, as outlined, even with this kind of improved fastening as compared to the prior art of that time, it is still necessary first to combine the individual needles.

For some applications it has become known to provide an outfit of so-called stamped sawtooth elements, which are attached either in the form of continuous sawtooth wires or individual sections of stamped elements, instead of an outfit of individual needles that must be arranged in the way described above. For the fastening of stamped elements it is known to provide dove-tail configurations, so as to be able to line and mount these stamped elements by positive fit on a round comb. Applicant's U.S. Pat. No. 4,606,095 is an example of this.

It has become apparent, however, that for certain applications, for instance in drawing equipment, it is more advantageous to provide needle bars than to use stamped elements.

DE 19 36 323 A1 of the species teaches, for the purpose of disentangling bunches of threads by needle combs, to line up sheet disks non-rotatably one beside the other, each round sheet disk having a projection denoted as a needle and extending radially for a comparatively short length referred to the diameter of the basic body of the disk. In this known embodiment, it was judged substantial to create a roller with a needle comb by using the thinnest possible metal sheet for the distance of the tips to be kept as small as possible, it being assumed, with a view to the application of such combing rollers, that the shape of the needle would be of no importance. Such rollers are not suitable for combing operations as occur for instance in drawing equipment, where a comparatively long and effectively combing tip area is required accompanied by a typically elongated configuration of the needle, the needle being provided with rounded edges to have the specific cross-sectional shape of a needle.

SUMMARY OF THE INVENTION

Based on this general concept, it is an object of the invention to embody needles and needle bars or rods equipped with these needles in such a way that the advantageous combing effects of needles can be achieved and easy replacing of the needles is still possible, there being minimum machine down-time for the replacement.

According to the invention, this object is solved in that for textile combing machines, in particular drawing equipment, for intersecting machines, feed combs, top combs, round combs or the like, the tip area of the needles is distinctly higher than the fastening area and is made approximately oval in cross-sectional shape by stamping.

This design is based on the idea that modern manufacturing technology allows the stamping of individual needles in such a way that the tip area exhibits the advantageous combing effect of individual needles. Simultaneously, this manufacturing technique offers the possibility of embodying the fastening area in the way according to the invention so that contrary to all prior art needle bars, it is no longer necessary to combine the needles to form a strip and to preassemble them correspondingly, but the conventional differentiation between the needle bar and the support rod is cancelled in that the needles can be placed directly and individually on the support rod, which can then be installed in the machine mechanically, for instance by screwing.

The recess may for instance be approximately oval or rectangular or have a portion open outwards, this open portion offering the possibility to slightly expand the recess elastically, thus ensuring a certain preliminary fixing during the lining up.

Alternatively or additionally, provision can be made for the fastening area to have a second recess for the lining up of the needles prior to their being mounted on the support rod. Correspondingly, the outfit comprising a line of needles for a support rod can be prepared, there being the possibility to replace the old outfit by a new one on the same needle bar in a short time.

The invention also relates to a needle bar, which is a needle rod in conventional terms, and which is characterized in that a support rod is provided, the cross-sectional configuration of which corresponds to the contour of the recess of the needles lined on it.

The support rod can have at least one longitudinal groove or longitudinal slot for a corresponding projection of the needles to engage with. This is particularly easy to realize in that the support rod is a slotted tube.

To obtain a needle bar or rod in which the needles are optimally spaced in the axial direction, spacers can be provided, the shape of which corresponds approximately to the shape of the fastening area of the needles, i.e. these spacers can be slipped on and lined up in the same simple manner.

Although not necessary within the scope of the design according to the invention, the fastening area of the needles can be bedded at least partially in a plastic body, so that a sort of conventional type needle bar is created, the advantage of very easy mounting on the support rod and in the machine being given in spite of the additional step of plastics casting.

In this latter embodiment, the plastic body can serve to form an interspace between two adjacent needles.

The invention further relates to a method of attaching or, respectively, replacing an outfit of needles of the type mentioned above, it being provided that the needles are slipped on an assembly tube approximately corresponding in cross-section to the support rod that is inserted in the combing machine, the combing machine operator, for attaching the outfit, aligning the assembly tube with the support rod—if required, after the removal of the old outfit—so that the whole of the needles intended for the respective support rod can be attached by a single slip-on operation. Then retentions have to be applied to the end, for instance in the form of screws, and the support rod is promptly ready for use.

Further details of the invention will become apparent from the ensuing description of a preferred embodiment, taken in conjunction with the drawing.

BRIEF DESCRIPTION OF THE DRAWING

FIG. 14 is a view of another embodiment of a needle according to the invention with an enlarged fastening area, FIG. 15 is a line of needles according to FIG. 14, FIG. 16 is a perspective view of a support rod according to the invention for pre-assembling, and FIG. 17 is a perspective view of a support rod according to FIG. 16 comprising a line of needles and an assembly tube.

DESCRIPTION OF THE PREFERRED EMBODIMENT

Figures 1, 2, 3, 4, 5, 6, 7, 8, 9, 10, 11, 12, 13:
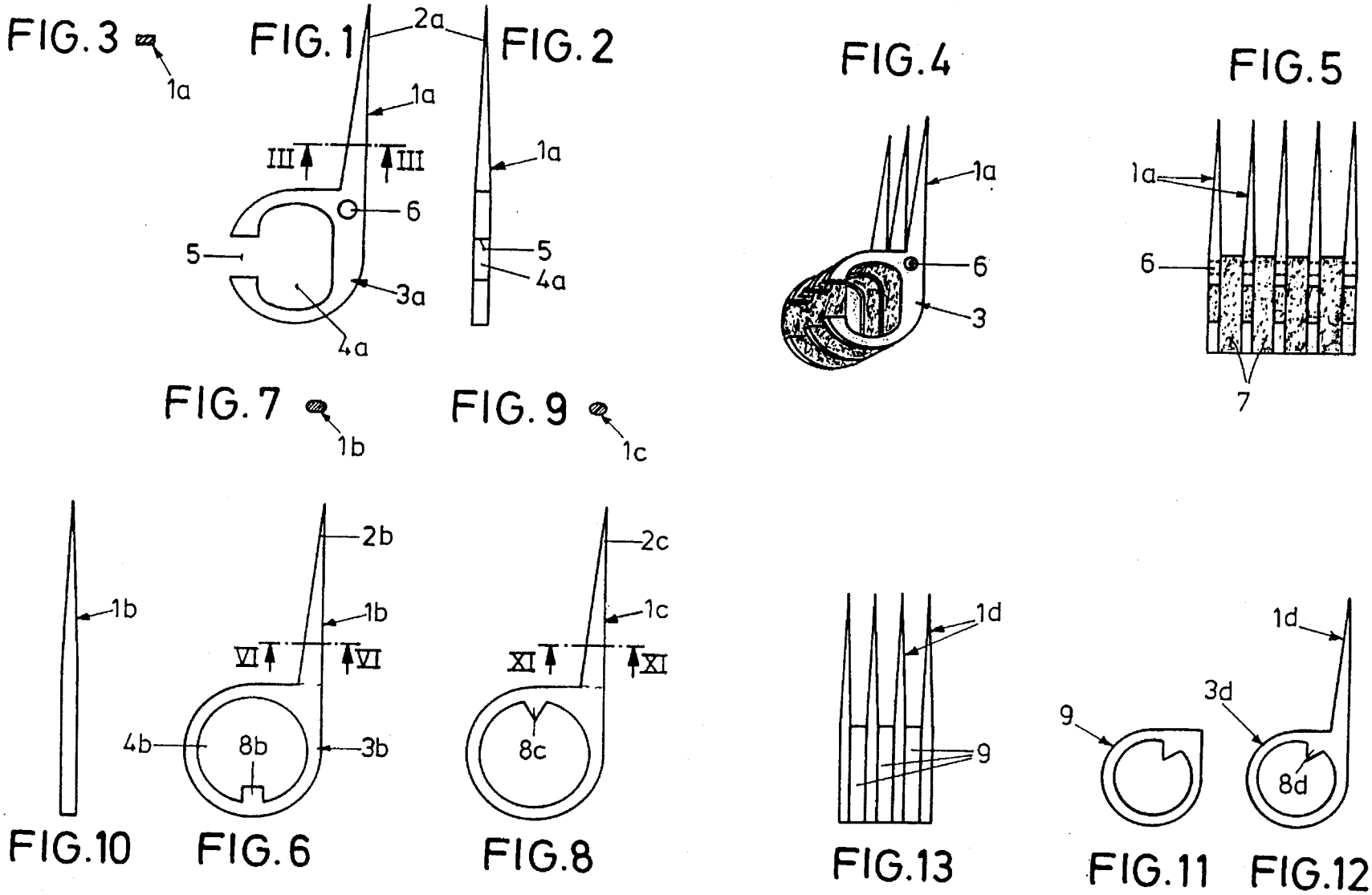
FIG. 1 is a view of a first embodiment of a needle according to the invention.
FIG. 2 is a view of the small face of the needle according to FIG. 1.
FIG. 3 is a section along the line III—III of FIG. 1.
FIG. 4 is a perspective view of a plurality of needles according to FIGS. 1 to 3 with a plastics cast fastening area.
FIG. 5 is a plan view of the line of needles according to FIG. 4.
FIG. 6 is a view of another embodiment of a needle according to the invention.
FIG. 7 is a section along the line VII—VII of FIG. 6.
FIG. 8 is a view of a third embodiment of a needle according to the invention.
FIG. 9 is a section along the line IX—IX.
FIG. 10 is a view of the small face of the needles according to FIGS. 6 and 8.
FIG. 11 is a view of a spacer according to the invention.
FIG. 12 is a view of another embodiment of a needle according to the invention, which corresponds to the spacer of FIG. 11.
FIG. 13 is a view of a line of spacers and needles according to FIGS. 11 and 12.

A needle 1*a* according to the invention and illustrated in FIGS. 1 to 3 comprises an actively combing-tip area 2*a* and a fastening area 3*a*.

As seen in particular from the combination of FIGS. 1 and 2, the actively combing tip area 2*a* is designed in the way of a conventional needle.

The fastening area 3*a* comprises a first recess 4*a* of some size, which has a portion 5 open outwards. The recess 4*a* is oval, which offers a safeguard against rotation during the mounting with elastic, positive fit on a support rod of corresponding shape.

A second recess 6 serves to preassemble the needles 1*a* by means of a thin rod so that they are even more easy to replace.

By alternative, the recess 6 may also be used to form a continuous, uniting plastic rod, if the fastening area is plastics cast so that a stable needle bar is produced, which is illustrated in FIGS. 4 and 5. The disks of the plastic body 7 between the individual needles 1*a* may function as spacers.

FIG. 6 is an illustration of another embodiment of a needle 1*b* according to the invention. In this embodiment, the fastening area 3*b* is provided with a recess 4*b* which is round and has a projection 8*b*. In the embodiment according to FIG. 8, the projection 8*c* is triangular in cross-section, while it is rectangular according to FIG. 6. The view of the small face of the embodiments according to FIGS. 6 and 8 becomes apparent from FIG. 10, the cross-sectional configurations of the respective tip area 2*b* or 2*c* from FIGS. 7 or 9.

In the embodiment of FIG. 12 showing a needle 1*d*, the projection 8*d* is also triangular. A spacer 9 shown in FIG. 11 is shaped in accordance with the fastening area 3*d* of the needle 1*d*, so that the needles 1*d* can be lined up with their tips at a defined interspace as a result of the intermediate spacers 9.

In the embodiment of the needles 1*e* according to FIGS. 14 and 15, the fastening area 3*e* is wider than the tip portion 2*e*, which can for instance be accomplished by the tip portion 2*e* being stamped correspondingly. Consequently, the needles 1*e* can be lined up without spacers, as seen in FIG. 15.

FIG. 16 is an illustration of a support rod 10 in the form of a tube with a longitudinal slot 11, the longitudinal slot 11 corresponding for instance to the width of the projection 8*b* of the needles 1*b*, so that these needles 1*b* can be lined up on the support rod 10 non-rotatably and with positive fit.

An assembly tube roughly outlined at 12 also has a slot 11' and can be used to facilitate the attachment of the outfit in that the outfit is first mounted on the assembly tube and then simply slipped on the actual support rod.

What is claimed is:

1. A needle for mounting on a support rod for use with textile combing machines, the needle (1) comprising a foot portion having a fastening area (3) and a single actively combing tip (2) formed on and projecting from the foot, the needle being a stamped element and the fastening area (3) having a first recess (4) for permitting the needle (1) to be slipped on a support rod (10), the first recess (4) and the support rod (10) having engagement means for slidable, non-rotatable engagement between the recess and the support rod (10), wherein on textile combing machines the tip (2) projects significantly above the fastening area (3) and is made approximately oval in cross-sectional shape by stamping.

2. A needle according to claim 1, wherein the first recess opens outward through the fastening area (3).

3. A needle according to claim 1, wherein the first recess is enclosed by the fastening area (3).

4. A needle according to claim 1, wherein said engagement means comprises the first recess which is non-circular and has indents corresponding to the cross-section of the support rod (10).

5. A needle according to claim 1, wherein said engagement means includes the first recess which is circular and has projections (8) corresponding to the cross-section of the support rod.

6. A needle according to claim 1, wherein the first recess (4) is approximately oval.

7. A needle according to claim 1, wherein a second recess (6) is provided beside the first recess (4) to permit the needles (1) to be lined up prior to being mounted on the support rod (10).

8. A needle according claim 1, wherein a number of the needle are engaged on the support rod to form a line of needles.

9. A needle according to claim 5, wherein the support rod (10) has at least a longitudinal groove (11) for a corresponding projection (8) of the needle (1) to engage with.

10. A needle according to claim 8, wherein the fastening area (3) of each needle of the line of needles is bedded at least partially in a plastic body (7).

11. A needle according to claim 10, wherein the plastic body (7) forms an interspace between two adjacent needles of the line of needles (1).

12. A needle according to claim 8, wherein each of the line of needles (1) has an enlarged fastening area (**3*e***).

13. A method for attaching needles to a support bar of a textile combing machine comprising, forming a number of needles having a fastening area and a combing tip projecting form the fastening area, providing the fastening area with a recess for engagement with the support bar, mounting the needles on an assembly tube having approximately the same cross-sectional size as the support bar, aligning the assembly tube with the support bar and transferring the needles from the assembly tube to the support bar.

14. A method according to claim 13, wherein the needles are mounted on the assembly tube for storage and later use.

* * * * *